US008215133B2

(12) United States Patent
Kim et al.

(10) Patent No.: US 8,215,133 B2
(45) Date of Patent: Jul. 10, 2012

(54) FABRIC TREATING MACHINE

(75) Inventors: Jong Seok Kim, Seoul (KR); Dae Yun Park, Seoul (KR); Dong Won Kim, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 889 days.

(21) Appl. No.: 12/271,064

(22) Filed: Nov. 14, 2008

(65) Prior Publication Data

US 2009/0126422 A1 May 21, 2009

(30) Foreign Application Priority Data

Nov. 16, 2007 (KR) ..... 10-2007-0117174

(51) Int. Cl.
*D06B 1/08* (2006.01)
*G01N 27/12* (2006.01)
*D06F 58/10* (2006.01)

(52) U.S. Cl. ..... 68/5 C; 34/528; 34/550; 34/566; 34/571

(58) Field of Classification Search ..... 68/5 R, 68/6, 5 C; 34/528, 550, 566, 571, 579, 621
See application file for complete search history.

(56) References Cited

U.S. PATENT DOCUMENTS

| | | | | |
|---|---|---|---|---|
| 3,702,030 | A * | 11/1972 | Janke | 34/498 |
| 4,385,452 | A * | 5/1983 | Deschaaf et al. | 34/562 |
| 4,477,982 | A * | 10/1984 | Cotton | 34/550 |
| 4,738,034 | A * | 4/1988 | Muramatsu et al. | 34/524 |
| 5,345,694 | A * | 9/1994 | Hayashi | 34/550 |
| 5,940,986 | A | 8/1999 | Jelinek et al. | |
| 7,975,400 | B2 * | 7/2011 | Dittmer et al. | 34/528 |
| 2002/0133969 | A1 | 9/2002 | Cassella | |
| 2004/0168344 | A1 | 9/2004 | Park | |
| 2004/0200093 | A1 * | 10/2004 | Wunderlin et al. | 34/606 |
| 2005/0155393 | A1 * | 7/2005 | Wright et al. | 68/3 R |
| 2005/0278972 | A1 | 12/2005 | Maruca | |
| 2006/0191161 | A1 * | 8/2006 | Wunderlin et al. | 34/562 |
| 2006/0248746 | A1 * | 11/2006 | Dittmer et al. | 34/534 |

FOREIGN PATENT DOCUMENTS

| | | |
|---|---|---|
| EP | 1 736 761 | 12/2006 |
| EP | 1 865 104 | 12/2007 |
| EP | 1 988 209 | 11/2008 |
| JP | 2003-181196 | 7/2003 |
| JP | 2007-037917 | 2/2007 |
| WO | WO 2004/091359 | 10/2004 |
| WO | WO 2006/100332 | 9/2006 |

OTHER PUBLICATIONS

Machine translation of JP 2007-037917A, no date.*
International Search Report and Written Opinion issued in PCT Application No. PCT/KR2008/006746 dated Oct. 15, 2010.
European Search Report issued in EP Application No. 08850213 dated Jun. 7, 2011.
Chinese Office Action issued in CN Application No. 200880124238.8 dated Feb. 29, 2012.

* cited by examiner

*Primary Examiner* — Joseph L Perrin
(74) *Attorney, Agent, or Firm* — KED & Associates, LLP

(57) ABSTRACT

A fabric treating machine is provided which supplies steam and hot air to fabric articles received in a receiving room to remove odors, wrinkles, moisture and the like remaining in the fabric articles. The fabric treating machine can control a drying process based on a level of dryness of the fabric articles determined by electrode parts provided with a hanging means and/or a rack system that supports the fabric articles in the receiving room.

22 Claims, 7 Drawing Sheets

FABRIC TREATING MACHINE

This application claims the benefit of the Patent Korean Application No. 10-2007-0117174, filed in Korea on Nov. 16, 2007, the entirety of which is incorporated herein by reference.

BACKGROUND

1. Field

A fabric treating machine is provided, and, more particularly, a fabric treating machine is provided that removes odors, wrinkles, moisture and the like from fabric articles.

2. Background

Odors, wrinkles, moisture and the like that remain in fabric articles such as, for example, clothing articles, may cause a user to perform unnecessary washing functions, thus shortening an expected life span of the articles and increasing cost. Additionally, even after washing and drying, wrinkles may remain in the fabric articles, thus requiring separate ironing work. A fabric treatment apparatus that removes odors, wrinkles, moisture and the like from fabric articles without undue wear on the articles would be desirable.

BRIEF DESCRIPTION OF THE DRAWINGS

The embodiments will be described in detail with reference to the following drawings in which like reference numerals refer to like elements wherein.

DETAILED DESCRIPTION

In order to remove odors, wrinkles, moisture and the like from fabric articles, a fabric treating machine may spray steam onto the fabric articles and use heated-air flow in order to dry the fabric articles that have been sprayed with steam. Although odors, wrinkles, moisture and the like may be significantly reduced by exposing the fabric articles to heated-air flow, moisture (for example, steam) may optimize the effects and provide for more complete elimination.

If steam is sprayed onto fabric articles in a fabric treating machine, fine water particles may be coupled to odor particles remaining in the depth of fibers of the fabric, and the water particles coupled to the odor particles may be, together, separated from the fabric during a drying process so as to remove odors from the fabric. The application of steam during the drying process may also lessen wrinkles remaining in the fabric articles.

Through the process described above, odors, wrinkles, moisture and the like may be removed from fabric articles, leaving the fabric articles in a more pleasant state. Such fabric articles may include, for example, clothing, bedding, table linens, draperies, and other such articles which may be subject to odors, wrinkles and the like, and which may benefit from the application of steam and/or heat. The steam supplied in order to remove odors, wrinkles, moisture and the like may be removed from the fabric articles during a drying process by supplying hot air or the like. However, a degree of dryness of each fabric may differ based on, for example, a type/weight of fabric, an amount of supplied steam, and the like.

Although a consistent amount of steam may be supplied to a receiving room in which the articles are treated, characteristics of the fabric will affect how moisture is absorbed, and the time and temperature required to dry the fabric. Thus, if there is difference in a degree of dryness, there may also be a difference in temperature, supply time and flow rate of hot air required to completely dry the fabric articles. However, if a drying process is unnecessarily performed, or excessive drying is performed, it may damage the fibers of the fabric.

A controller that allows a fabric treating machine to perform a drying process that actively sets and adjusts based on a dryness of the fabric articles, rather than performing a passive drying process, would improve performance and utility of the fabric treating machine.

Figure 1:
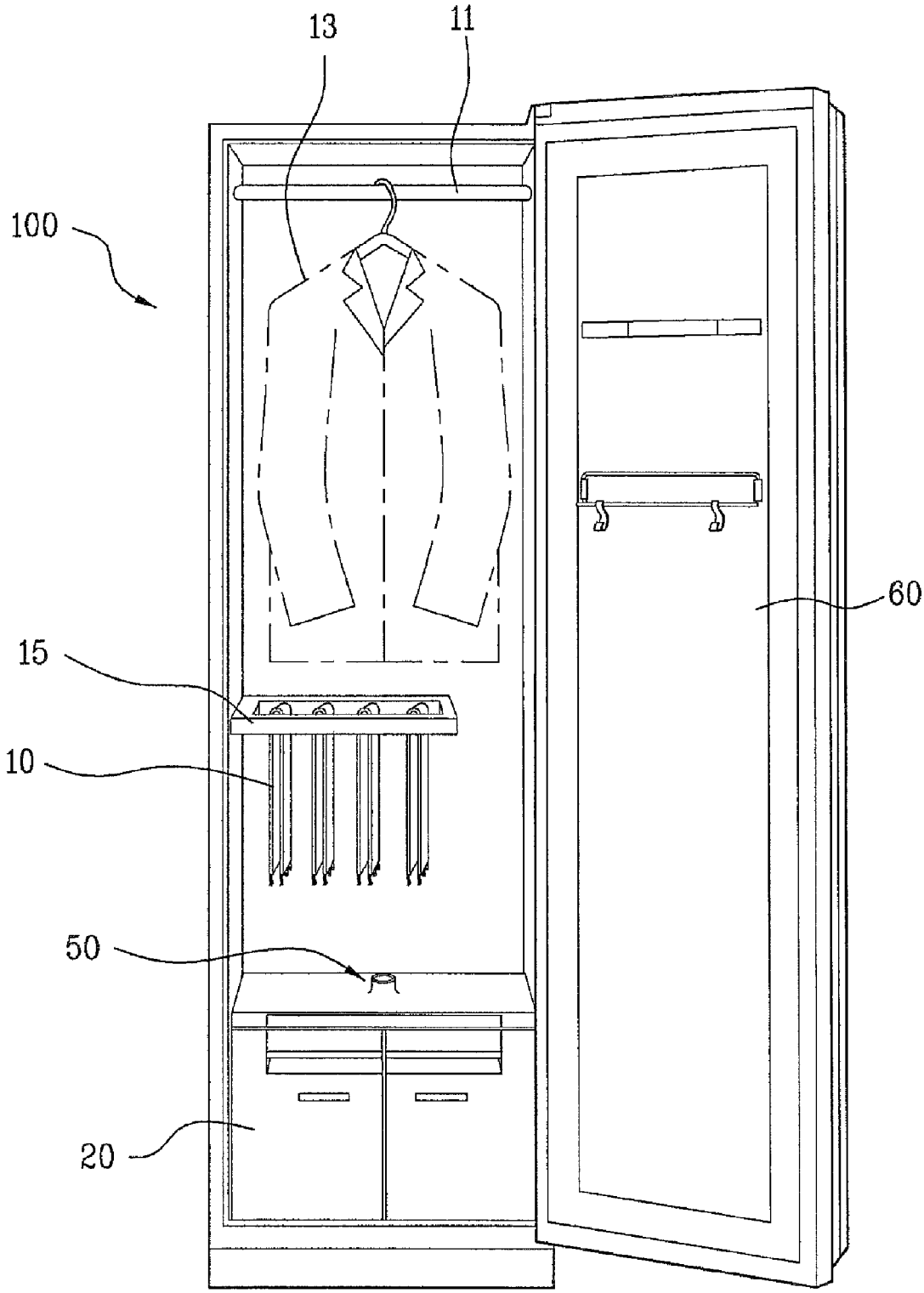
FIG. 1 is a perspective view of a fabric treating machine as embodied and broadly described herein.

FIG. 1 is a perspective view of a fabric treating machine 100 in accordance with an embodiment as broadly described herein. The fabric treating machine 100 may have a cabinet shape, with a receiving room 10 formed therein which is opened and closed by a door 60. A machine room 20 housing various components, such as, for example, a steam generator (not shown in FIG. 1) that generates steam and a heated-air supplier (not shown in FIG. 1) that generates hot air may be located at a lower portion of the cabinet.

A hanger 13 that holds fabric items and a horizontal bar 11 are configured to hold items to be treated so that, for example, several items may be hung simultaneously inside the receiving room 10. In alternative embodiments, the hanger 13 and/or horizontal bar 11 may be specifically configured to support various types of fabric articles, such as, for example, clothing, bedding, draperies and the like. For example, a rack 15, may be provided to receive articles which cannot be easily hung on the hanger 13.

The steam generator may spray steam into the receiving room 10 through a steam spraying device 50 provided at a lower portion of the receiving room 10, or other position as appropriate. The steam generator and the heated-air supplier may be controlled by a controller (not shown) that controls the supply of steam or hot air in order to perform a selected treating process.

In the embodiment shown in FIG. 1, the hanger 13 and horizontal bar 11 serve as hanging means. Electrode parts (not shown in FIG. 1) may be provided with the hanging means, spaced apart from each other and connected electrically to the controller that controls the steam generator and the heated-air supplier.

Figure 2:
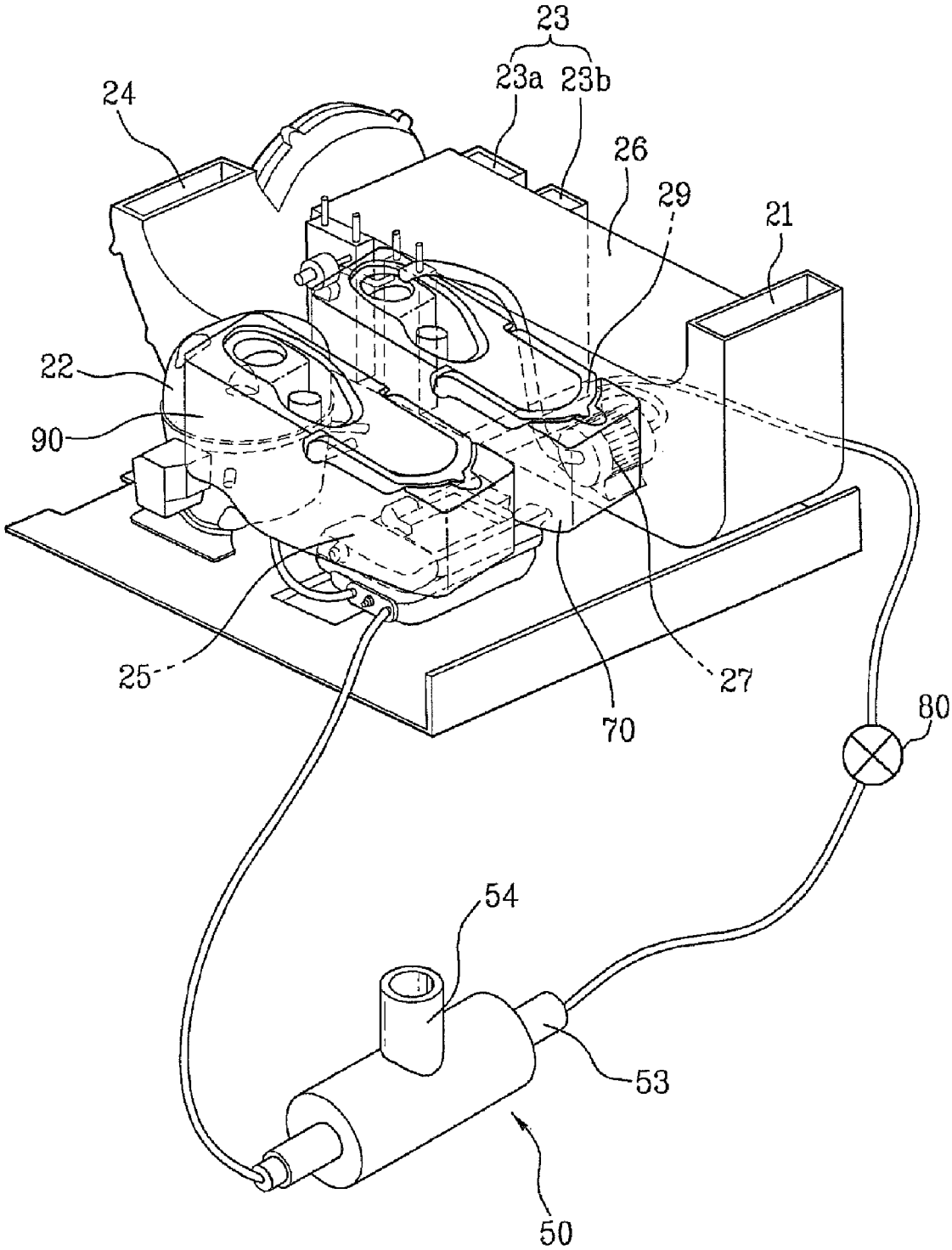
FIG. 2 is a view of an inside of a machine room of the fabric treating machine shown in FIG. 1.

FIG. 2 provides an exemplary view of an inside of the machine room 20 and exemplary components housed therein.

The machine room 20 may house a steam generator 25 that generates and supplies steam to the receiving room 10 and a heated-air supplier that generates and supplies hot air to the receiving room 10. The heated air-supplier may be, for example, a heat pump or an electric heater that heats dehumidified air. In either instance, the heated-air supplier may include a condensing part 23*b* that condenses moisture of wet air drawn in through an inlet port 21, and a heating part 23*a* that heats air that has been dehumidified in the condensing part 23*b*. A heating part 23*a* may be included with a heat exchanger of the heat pump, or an electric heater. Even when a heat pump is used for dehumidifying and heating wet air, a separate electric heater may be provided, in addition to the heat pump, for sufficiently heating the dehumidified air.

In the embodiment shown in FIG. 2, the heated-air supplier uses a heat pump method. The heated-air supplier shown in FIG. 2 includes a compressor 22 that compresses refrigerant, a heat exchanger 23 including a condensing part 23*b* and a heating part 23*a* that perform dehumidification and heating, respectively, and a blowing duct 24 that blows the dehumidified and heated air into the receiving room 10. In certain embodiments, the blowing duct 24 may be shaped so that its duct and fan are integrally formed. Other shapes/configurations may also be appropriate.

Air drawn into the inlet port 21 may be dehumidified in the condensing part 23*b* of the heat exchanger 23, heated in the heating part 23*a*, and supplied again to the receiving room 10 through the blowing duct 24. Thereafter, the drying process inside the receiving room 10 and may be repeated and the moist air recirculated back into the inlet port 21.

Through repetition of the processes described above, the fabric articles received in the receiving room may be dried. The location of the inlet port 21 and the blowing duct 24 inside the receiving room 10 may be determined based on the location of the steam generator 25, the rod 11 and the hangers 13, the rack 15 and the like. In the embodiment of FIG. 2, the inlet port 21 and the blowing duct 24 are installed in the front and the rear on a bottom surface of the receiving room 10, respectively, so that the air drying the fabric articles received in the receiving room 10 circulates along an oval trace.

A fabric treating machine as embodied and broadly described herein may include a drying function which dries fabric articles in the receiving room 10 using, for example, a condensing type system or an exhausting type system. The embodiment shown in FIG. 2 illustrates a condensing/circulating type system that condenses and heats w the air, and then recirculates the air back into the receiving room without exhausting. However, a fabric treating machine as embodied and broadly described herein may also use an exhausting type system.

The heat exchanger 23 dehumidifies wet air which has been circulated through the receiving room 10 during an evaporation process using a refrigerant supplied from the compressor 22, and heats the dehumidified air through a condensation process of the refrigerant. Compression of refrigerant may be conducted between the evaporation process and condensation process in the compressor 22 provided inside the machine room 20.

A draining part 70 may be provided in the machine room 20. Fluid condensed in the heat exchanger 23 may be collected in a collecting box 29 located below the heat exchanger 23, and delivered to and stored in the draining part 70.

In alternative embodiments, the draining part 70 may be provided as part of an external sewer pipe or the like, instead of in detachable form as long as the fabric treating machine 100 is installed in a place having a sewer/drainage system or the like. Therefore, simply for ease of discussion, embodiments in which the draining part 70 is formed as a detachable water box will be described.

When so configured, the draining part 70 may be selectively separated from the machine room 20, taking size/shape/capacity and the like of the draining part 70 into consideration, making it possible to discharge waste/sewage products contained therein. The movement of the sewage from the collecting box 29 to the draining part 70 may be done by a drain pump 27 or the like.

To facilitate removal of the draining part 70 from the machine room 20, the draining part 70 may be located at an upper part of the machine room 20. When so configured, a difference in installation height/position between the collecting box 29, located below the heat exchanger 23, and the draining part 70 maybe compensated for by the pump 27. Thus, the collecting box 29 may be smaller than the draining part 70.

The steam generator 25 provided inside the machine room 20 may generate steam from fluid supplied by a fluid supplying part 90. In certain embodiments, such as in FIG. 2, the fluid supplying part 90 is provided inside the machine room 20. The water supplying part 90 is provided in a detachable box form similar to the draining part 70, as only a small amount of fluid is required to generate an appropriate amount of steam.

In alternative embodiments, the fluid supplying part 90 may be directly connected to an external fluid supply when such an external supply is readily available. The fluid supplying part 90 supplies fluid to the steam generator 25, and the steam generator 25 sprays steam through the steam spraying device 50.

In certain embodiments, the steam generator generates steam by heating a predetermined amount of fluid contained in a tank having a predetermined size, with a built-in heater (not shown). However, any apparatus capable of generating steam may be used as the steam generator. For example, a heater may be directly installed on a circumferential surface of a supply hose, thus eliminating the need to store fluid in a predetermined space. Other means for generating steam may also be appropriate.

The steam spraying device 50 may be connected to the steam generator 25 and the draining part 70. Connection to the draining part 70 allows for recovery of condensed fluid generated while steam inside the steam spraying device 50 is sprayed.

However, considering that the temperature of condensed steam is relatively high, the condensed fluid may be allowed to remain in the steam spraying device 50 for a predetermined time so that it may be vaporized again, rather than allowing the condensate to be drained as soon as it is generated. Also, if the condensate remains inside the steam spraying device 50, an interior space of the spraying device 50 is reduced so that the supplied steam may be sprayed more easily. And, the high temperature condensate may help to keep the supplied steam warm. Therefore, the condensed steam accumulated in the steam spraying device 50 may remain in the steam spraying device 50 for a predetermined time.

In order to allow the condensate to remain inside the steam spraying device 50, a valve 80 may be provided between a condensate outlet 53 of the steam supplying device 50 and the draining part 70. The valve 80 may interrupt the flow of condensate from the outlet 53. The valve 80 may be, for example, an electronic valve controlled by a controller (not shown), or other type of valve as appropriate.

In the embodiment shown in FIG. 2, the condensate accumulated in the steam spraying device 50 is not directly drained to the draining part 70, but passes through the collecting part 29. If the condensate is temporarily stored in the collecting part 29 and then is drained by the pump 27, the condensate may be drained together with condensate from the heat exchanger 23, which may be more efficient.

In the embodiment shown in FIG. 2, the detachable draining part 70 and fluid supplying part 90 may be provided in the machine room 20 by being mounted in a drawer (not shown) that is movable forward and backward, into and out of the machine room 20. Therefore, a pipe provided in the collecting box 29 may be selectively connected to the detachable draining part 70 or a sewer (not shown).

The heated-air supplier and the steam supplier may be controlled by the controller based on a level of dryness of fabric articles received in the receiving room 10. A method of determining such a dryness level will now be described.

Figure 3:
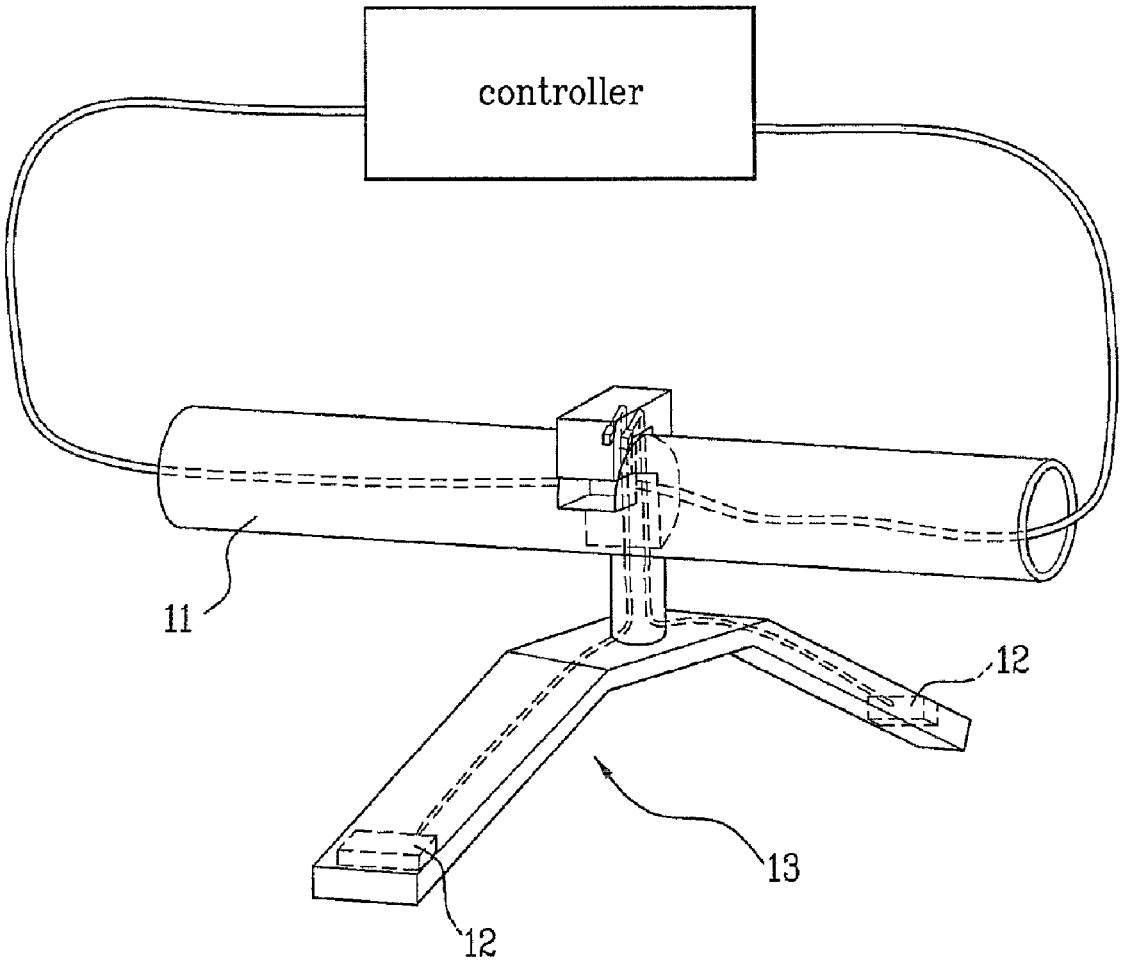
FIG. 3 illustrates a hanger and a hanger bar that supports the hanger which may be received in a receiving room of the fabric treating machine shown in FIG. 1.
Figure 4:
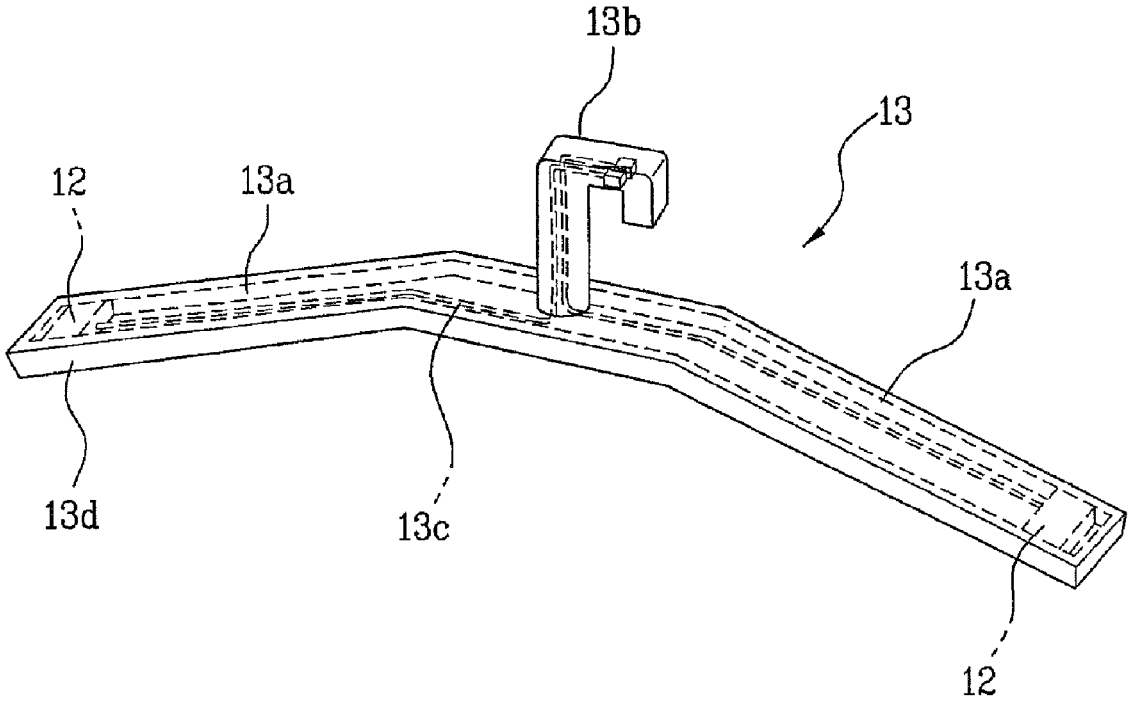
FIG. 4 is a perspective view of the hanger shown in FIG. 3.

The hanger 13 shown in FIG. 3 includes a pair of electrode bars 12 electrically connected to the controller. The electrodes 12 may be exposed at opposite ends of the hanger 13 so as to also be exposed to fabric articles hanging thereon. For example, the embodiment of FIG. 3, the electrodes 12 would contact shoulder portions of suits hanging on the hanger 13. The hanger 13 shown in FIG. 4 includes a pair of arm parts 13*a* and a ring 13*b* provided at a center portion of the arm parts 13*a*. The ring 13*b* is coupled to the horizontal bar 11. The electrodes 12 may be exposed on the arm parts 13*a*, respectively.

The arm parts 13*a* may be electrically connected to the ring 13*b* by a conductor buried therein. The ring 13*b* may be connected to the controller through the horizontal bar 11. A conductor 13*c* that electrically connects the electrode parts 12 to the controller may be exposed on a lower surface of the ring 13*b* for selective contact with the bar 11. The conductor 13*c* may be, for example, a wire made of metal, or the like. The conductor 13*c* serves to connect each electrode part 12 to the controller via the horizontal bar 11. The horizontal bar 11 may also have a built-in conductor, to be described later. In certain embodiments, the exteriors of the arm parts 13*a* and ring 13*b* may be covered with a housing 13*d* made of an insulating material such as, for example, a plastic material. Thus, although electrode parts 12 are exposed at both ends of the arm parts 13*a*, parts other than the electrode parts 12 may be insulated. Likewise, an internal conductor part of the ring 13*b*, that contacts the horizontal bar 11, may be exposed to establish an electrical connection with the conductor provided in the horizontal bar 11.

Figure 5:
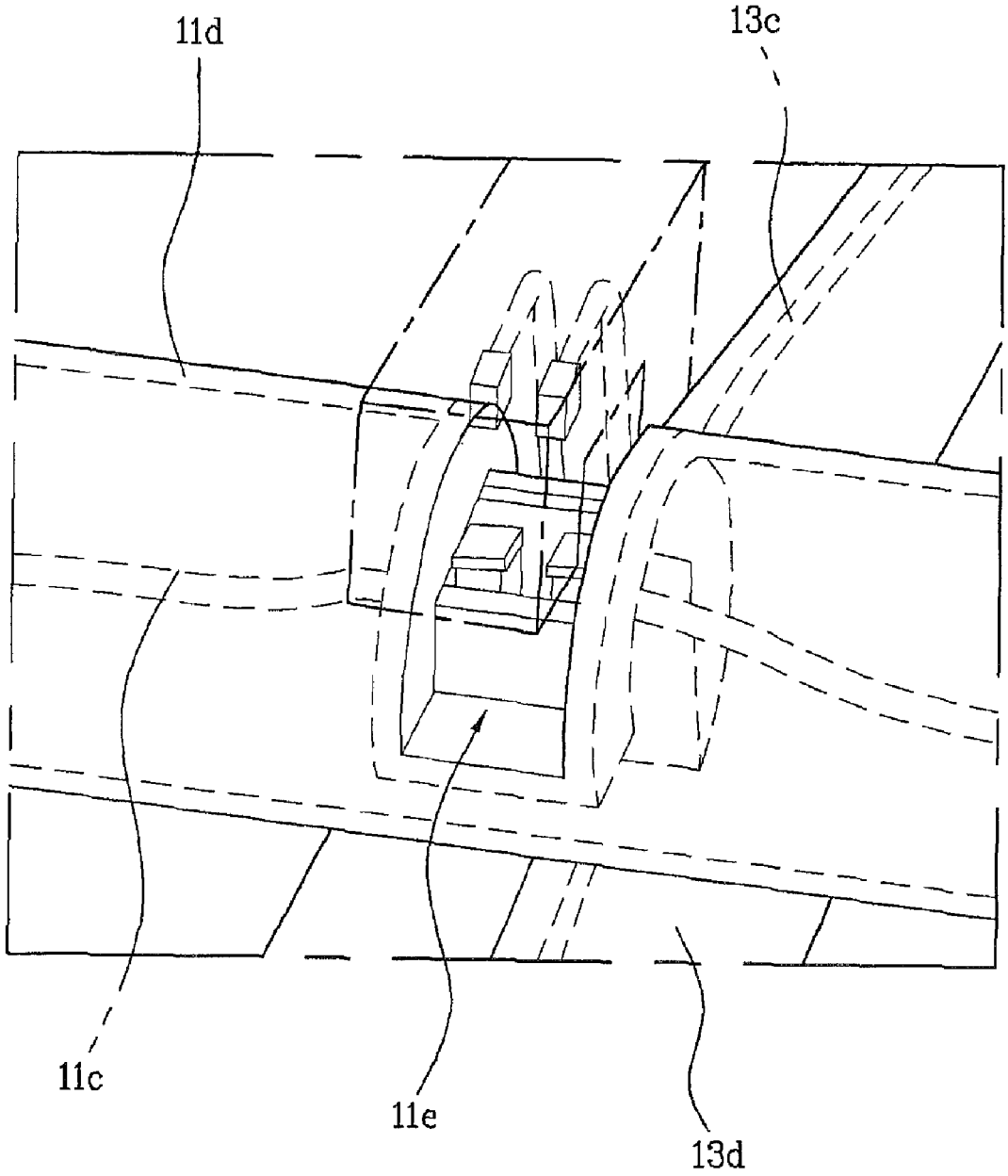
FIG. 5 is an enlarged perspective view of a hanger coupling portion of the horizontal bar shown in FIG. 3.

The horizontal bar 11 shown in FIG. 5 may include a conductor 11*c* provided therein, similar to the hanger 13. The horizontal bar 11 may also include a plurality of mounting grooves which each receive the ring 13*b* of a corresponding hanger 13 so that a plurality of hangers 13 may be simultaneously coupled to the horizontal bar 11.

Each conductor 11*c* may be exposed at the respective mounting grooves 11*e*, and conductors 13*c* provided inside the hanger 13 contact the conductors 11*c* provided in the horizontal bar 11 at the mounting grooves 11*e*, such that the electrode parts 12 can be connected electrically to the controller via the horizontal bar 11. The conductors 11*c* and 13*c* may be electrically connected using a method that safely seats the ring 13*b* of the hanger 13 in the mounting groove 11*e*, and the conductors 13*c* may be connected to the controller. Therefore, the electrode parts 12 provided at both ends of the arm parts 13*a* of the hanger 13 may be electrically connected to the controller.

In order to determine a level of dryness of the fabric articles hanging on the hangers 13 in the receiving room 10, the electrode parts 12 may calculate impedance associated with the fabric articles. The impedance associated with the fabric articles received in the receiving room 10 is related to the electrical conductivity of the fabric articles. In other words, the electrical conductivity of the fabric articles may vary based on the dryness of the fabric articles. Therefore, if the electrical conductivity is measured, the degree of dryness of the fabric articles may be determined.

The electrode parts 12 may be electrically connected to the controller, such that an impedance level of the fabric contacting the electrode parts 12 may be measured by applying current or voltage to the electrode parts 12. Since such values change with respect to time, root means square (RMS) values of current and voltage may be used. Therefore, if the RMS values of the alternating current (AC) voltage is Ve, the impedance Z of fabric contacting the electrode parts 12 may be determined, as Z=Ve/Ie. Therefore, the controller may apply a known current or voltage and then calculate an impedance level based on a measured, actual, value of voltage or current experienced at the electrode parts 12.

The impedance may refer to a degree of difficulty which current encounters when flowing in an AC circuit. Impedance is measured in ohms, Ω, and is generally represented by the symbol Z. Impedance may represent composite resistance of an AC circuit in which resisters, coils, and a storage battery are connected in series. A measured impedance level of the fabric may be used to determine the electrical conductivity of the fabric, and ultimately, a corresponding dryness level of the fabric.

Wet fabric, which has a relatively low dryness level, has a relatively high electrical conductivity level that allows current to flow relatively well, and thus a corresponding impedance level will be relatively low. In contrast, impedance will be relatively high in the opposite case, when the fabric is relatively dry and thus conductivity is relatively low.

Thus, when a measured impedance of the fabric is low, it means that the moisture content of the fabric is high. In contrast, when a measured impedance of the fabric is high, it means that the moisture content of the fabric is low. Therefore, the controller may select an appropriate operation condition of the heated-air supplier based on the measured impedance level to ensure that the fabric is appropriately, but not excessively, dried.

The operation condition of the heated-air supplier may include, for example, supply time, temperature, flow rate and the like associated with the hot air supplied by the heated-air supplier.

The controller may also control the steam supplied by the steam generator 25 based on the dryness level determined by the electrode part 12. This may be used as a means to determine whether or not an appropriate amount of steam has been supplied to the receiving room 10 to remove odors and wrinkles from the fabric articles.

The fabric treating machine as embodied and broadly described herein may include other hanging means having a different shape/size/configuration. The hanging means may be, for example, a rack having a plurality of horizontal bars capable of hanging fabric articles therefrom.

Figure 6:
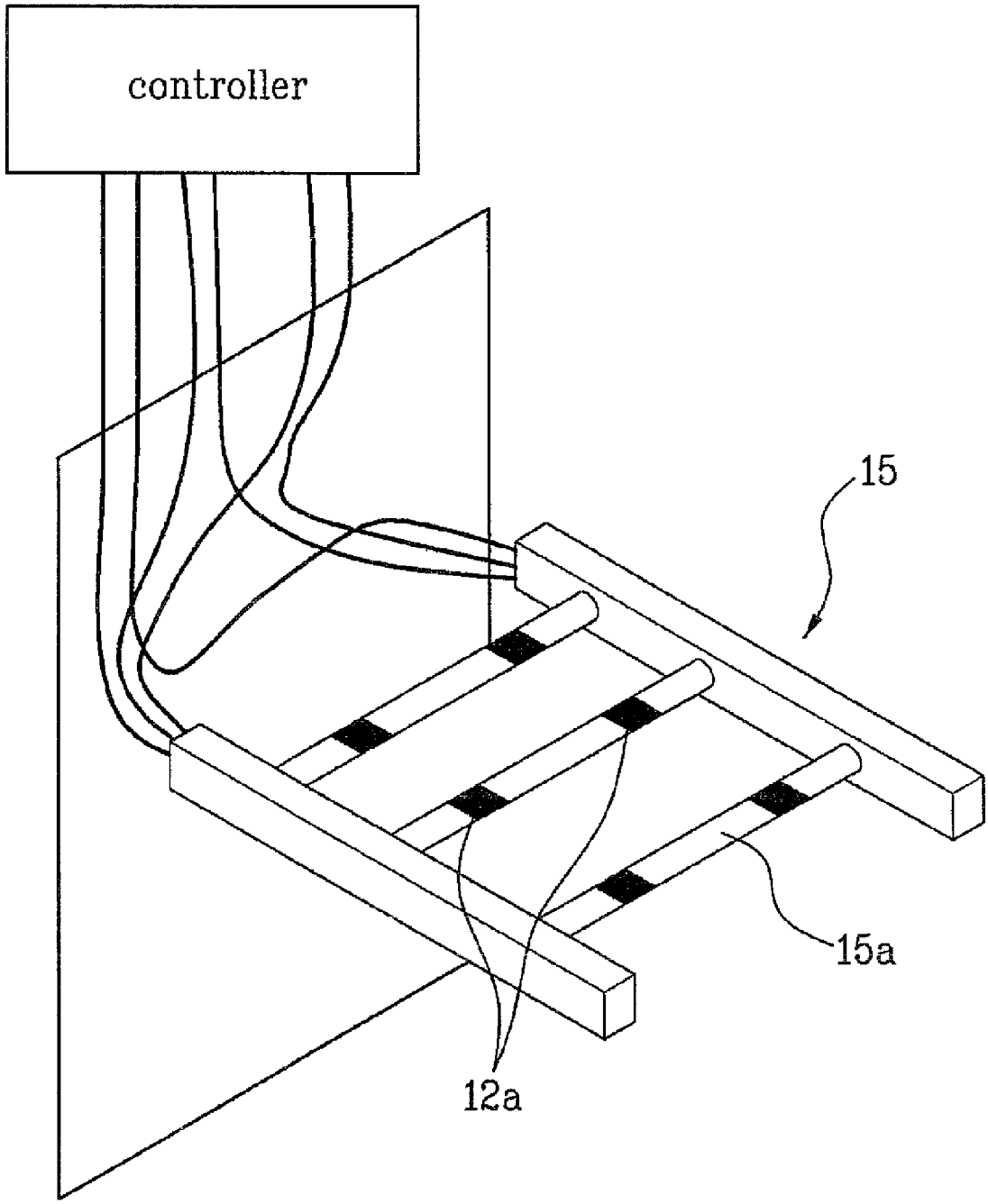
FIG. 6 is a perspective view of a rack which may be provided with the fabric treating machine shown in FIG. 1.

The rack 15 shown in FIG. 6 includes a plurality of horizontal bars 15*a*. A pair of electrode parts 12*a* may be provided with each of the horizontal bars 15*a*. The electrode parts 12*a* may be provided in a similar manner as that the electrode parts 12 of the hanger 13 shown in FIG. 3, and may be similarly connected to the controller. If a plurality of the horizontal bars 15*a* are provided, a pair of electrode parts 12*a* are provided for each horizontal bar 15*a*, and each may be connected electrically to the controller. In this manner, a dryness level of the fabric articles hanging on the horizontal bars 15*a* of the rack 15 can be determined, in addition to the dryness level of fabric articles hanging on the hangers 13. The rack 15 may be mounted on an inner wall surface of the receiving room 10. In order to optimize the utility of the space within the receiving room 10, the rack 15 may be foldable so that it will not occupy space in the receiving room 10 when the rack 15 is not in use.

Figure 7:
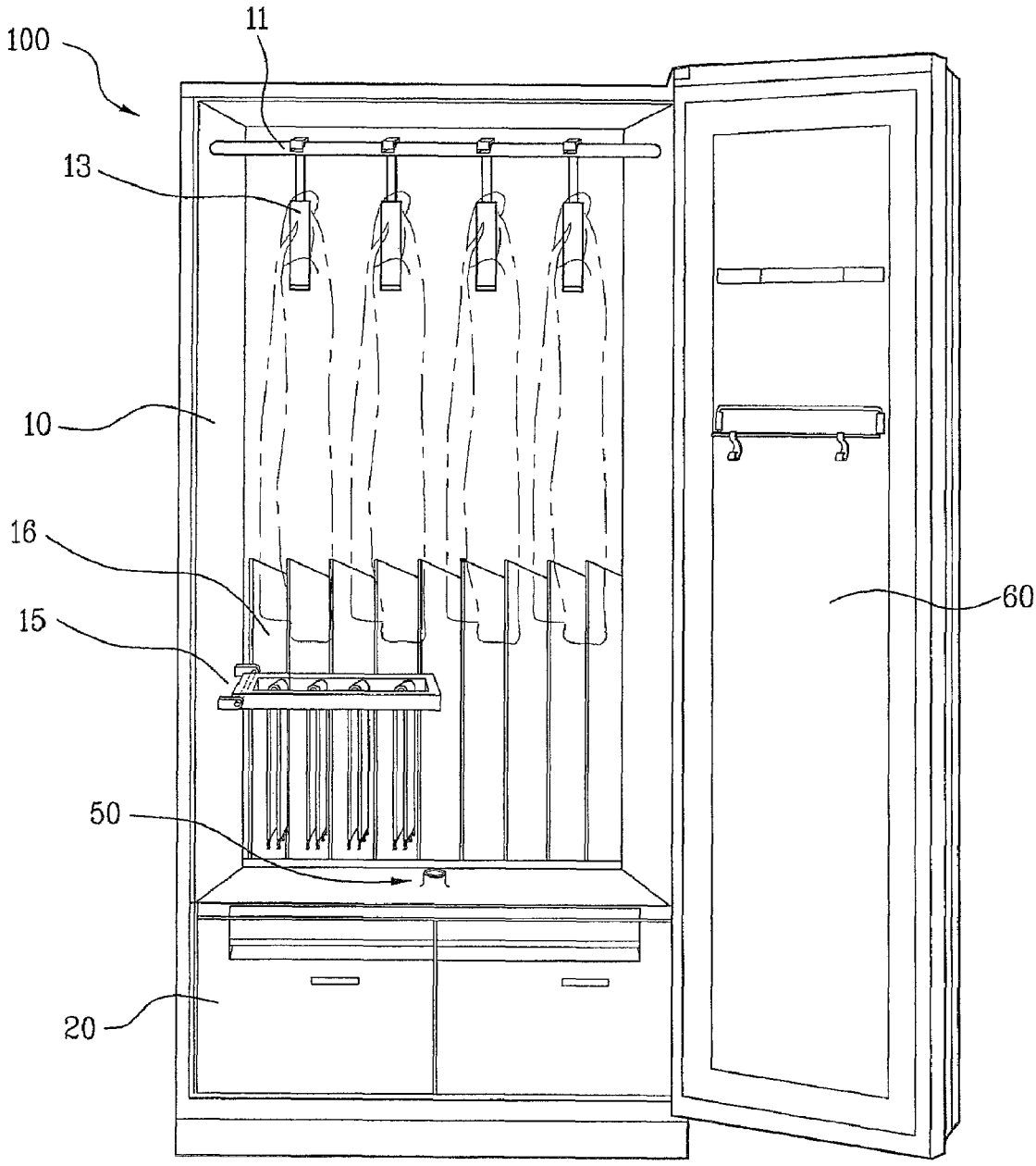
FIG. 7 is a perspective view of a fabric treating machine in accordance with another embodiment as broadly described herein.

FIG. 7 is a perspective view of another fabric treating machine as embodied and broadly described herein. In this embodiment, the fabric treating machine 100 may include at least one flapper 16 provided at a side of the receiving room 10 through which hot air supplied from the heated-air supplier enters. The flappers 16 may have a plate shape, and may be controlled by the controller to adjust a rotation angle of the flappers 16.

The outlet may be formed in the receiving room 10 at a position corresponding to the blowing duct 24 shown in FIG. 2.

The plurality of flappers 16 shown in FIG. 7 have a long rectangular shape and are mounted vertically to a rear wall surface of the receiving room 10 in parallel to each other, at a blowing duct 24 side of the receiving room 10. In alternative embodiments, the flappers 16 may have other shapes, and be mounted horizontally, diagonally, or at other orientations as appropriate. The hot air supplied from the heated-air supplier moves from the bottom to the top of the receiving room 10 so that, although the flappers 16 are located at a lower portion of the receiving room 16, the direction of the not air supplied to the receiving room 10 may be controlled to a certain degree by rotation of the flappers 16.

Rotation of the flappers 16 allows the supply of hot air to be concentrated on fabric articles having relatively low dryness levels. When comparing the dryness levels of fabric articles received in the receiving room 10, if the dryness level of a fabric article received in a certain direction is lower than that of a fabric article located in another location, the controller changes the rotation angle of the flappers 16 to supply hot air in the direction of the fabric articles having low dryness, making it possible to dry the received fabric articles more evenly. The flappers 16 may rotate so as to supply hot air to the fabric articles low dryness from amongst the fabric articles received in the receiving room 10 making it possible to optimize efficiency of the drying process.

Through the method described above, the dryness of the fabric articles received in the receiving room 10 is determined, making it possible to apply hot air supplied from the heated-air supplier more efficiently.

The indirect information related to the dryness level measured by the electrode parts may be used not only in the airing process, but also in the process of supplying steam to the receiving room.

A fabric treating machine as embodied and broadly described herein supplies steam to the fabric articles in order to remove odors or wrinkles remaining in the received fabric articles. However it may also be used to control an appropriate amount of steam supplied to the received fabric articles.

In other words, whether an appropriate amount of steam has been supplied may also be determined by the electrode parts contacting the fabric articles. In other words, the electrical conductivity or impedance of the fabric articles is measured and when the requested amount of steam is supplied, the supply of steam is discontinued.

The steam supplier supplying steam to the receiving room or the heated-air supplier dehumidifying and heating air inside the receiving room is controlled by the controller, such that the information related to the dryness level of the fabric articles measured by the electrodes parts provided with the hanger and the rack and contacting the fabric articles can be utilized diversely.

In a fabric treating machine as embodied and broadly described herein, in order to remove odors, wrinkles, moisture and the like remaining in received fabric articles, steam is sprayed, and hot wind is supplied or blown in order to dry fabric articles that contain moisture due to the sprayed steam, making it possible to remove the odors, wrinkles, moisture and the like. Also, the heated-air supplier is controlled by measuring the dryness level of received fabric articles making it possible to dry the received fabric articles efficiently.

Also, hot air supply may be concentrated to a region where the dryness level of a portion of received fabric articles is low, making it possible to dry the fabric articles evenly.

A laundry treating machine is provided capable of determining an operation condition of a heated-air supplier provided inside a machine room or determining the direction of hot air supplied from the heated-air supplier by measuring the dryness of laundry received in a receiving room.

A laundry treating machine as embodied and broadly described herein may include a cabinet having a receiving room receiving laundry; a heated-air supplier provided in a space inside the cabinet partitioned from the receiving room, dehumidifying or heating air of the receiving room and re-supplying it to the receiving room; at least one hanging means provided in the receiving room for hanging the received laundry; at least two electrode parts mounted to the hanger and spaced each other; and a controller controlling the heated-air supplier and electrically connected to the electrode parts.

The hanging means may be a hanger and a horizontal bar capable of detachable mounting the hanger.

The hanger may have a pair of arm parts and a ring provided on a center portion of the arm parts and each electrode part may be mounted to be exposed on the arm parts respectively.

The electrode part may be connected to the controller by a conductor buried in the hanger and the horizontal bar.

The horizontal bars may have a plurality of mounting grooves capable of mounting the hangers, the conductor of the hanger and the horizontal bar contacting each other at the mounting groove.

The controller may determine an operation condition of the heated-air supplier according to an impedance value of laundry contacting the electrode part of the hanger.

The hanger may be a rack comprising at least one horizontal standing bar and the electrode parts may be provided to at least one of the horizontal bars.

The rack may be mounted on an inner wall surface of the receiving room to be able to be folded by a hinge.

The controller may determine the operation condition of the heated-air supplier according to the impedance value of laundry contacting the electrode part of the rack.

The laundry treating machine may also include at least one flapper in a plate shape, which is rotatably mounted on an outlet side of hot air supplied from the heated-air supplier and is controlled by the controller, the controller controlling a rotation angle of the flapper.

The controller may determine the rotation angle of the flapper according to the impedance value of laundry contacting the electrode part.

The operation condition of the heated-air supplier may include at least one of supply time, temperature, and flow rate of hot air.

The laundry treating machine may also include a steam generator controlled by the controller and generating steam supplied to the receiving room.

The controller may determine the operation condition of the steam generator according to the impedance value of laundry contacting the electrode part.

The operation condition of the steam generator may also include a supply time of the steam.

A laundry treating machine as embodied and broadly described herein may include a receiving room receiving laundry; a steam generator supplying steam to the receiving room; a heated-air supplier drying the laundry received in the receiving room; and a controller connected to the steam generator and the heated-air supplier; and a hanger or a rack connected to the controller electrically for judging the dryness of laundry received in the receiving room; capable of judging dryness of laundry received in the receiving room based on a degree of electric conduction.

The laundry treating machine may also include a plurality of flappers mounted rotatably on an inner wall surface of the receiving room for guiding the direction of heated-air supplied from the hot air supplier.

Any reference in this specification to "one embodiment," "an embodiment," "example embodiment," "certain embodiments," "alternative embodiments," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A fabric treating apparatus, comprising:

a cabinet that defines an interior space, wherein the interior space is partitioned into a receiving space and a component space;

a heated air supplier provided in the component space, wherein the heated air supplier receives air from the receiving space, dehumidifies or heats the received air, and resupplies the air to the receiving space;

a plurality of holding devices provided in the receiving space and configured to receive articles thereon to be treated;

at least one electrode part provided on each of the plurality of holding devices so as to contact the articles received thereon;

at least one flapper rotatably coupled to an inner wall surface of the receiving space; and a controller that is electrically connected to the at least one electrode part of each of the plurality of holding devices, wherein the controller controls operation of the heated air supplier and adjusts a position of the at least one flapper based on input from the at least one electrode of each of the plurality of holding devices, and wherein the controller is configured to rotate the at least one flapper so as to direct heated air toward one or more articles determined to have a lowest dryness level of the articles received in the receiving space.

2. The apparatus of claim 1, wherein the plurality of holding devices comprises:

a horizontal bar that extends across the receiving space; and at least one hanger that is detachably coupled to the horizontal bar.

3. The apparatus of claim 2, wherein the at least one hanger comprises:

a ring that is detachably coupled to the horizontal bar; and a pair of arm parts that extend outward from opposite sides of the ring, wherein the at least one electrode part comprises a pair of hanger electrode parts that are respectively provided on the pair of arm parts so as to be exposed to an article held on the hanger.

4. The apparatus of claim 3, wherein the pair of hanger electrode parts is electrically connected to the controller by a first conductor provided in an interior of the hanger and a second conductor provided in an interior of the horizontal bar.

5. The apparatus of claim 4, wherein the horizontal bar comprises at least one groove formed therein so as to receive the at least one hanger, wherein the second conductor is exposed at the at least one groove formed in the horizontal bar, and the first conductor is exposed at the ring of the at least one hanger such that the first and second conductors make contact and the pair of hanger electrode parts are electrically connected to the controller when the hanger is received in the groove.

6. The apparatus of claim 5, wherein the pair of hanger electrode parts are configured to contact an article held on the hanger and to measure an impedance value of the article, and the controller is configured to determine a level of dryness of the article based on the impedance value measure by the pair of hanger electrodes, and to control the heated air supplier based on the impedance value and the dryness level.

7. The apparatus of claim 6, wherein the controller controls at least one of supply time, temperature, or flow rate of heated air supplied by the heated air supplier based on the measured impedance value and the dryness level.

8. The apparatus of claim 7, further comprising a steam generator provided in the component space, wherein the steam generator generates and supplies steam to the receiving space, and wherein the controller is configured to control the steam generator based on the measured impedance value and the dryness level.

9. The apparatus of claim 7, wherein the at least one flapper is positioned near a discharge of the heated air supplier into the receiving space, wherein the controller controls a rotation angle of the at least one flapper based on the measured impedance value and the dryness level.

10. The apparatus of claim 3, wherein the plurality of holding devices further comprises a rack provided in the receiving space, spaced apart from the horizontal bar, wherein the rack comprises:

at least one support bar coupled to an inner wall surface of the receiving space;

at least one receiving bar coupled to the at least one support bar, wherein the at least one receiving bar receives articles thereon to be treated; and at least one rack electrode part provided with the at least one receiving bar so as to be exposed to and contact the articles received thereon.

11. The apparatus of claim 10, wherein the pair of hanger electrode parts and the at least one rack electrode part are configured to measure impedance values of articles received on the at leas tone hanger and the at least one receiving bar, respectively, and the controller is configured to determine respective levels of dryness based on the measured impedance values, and to control the heated air supplier and the at least one flapper based on the impedance values and the dryness levels.

12. The apparatus of claim 11, wherein the at least one support bar comprises a pair of support bars spaced apart by a predetermined interval, and the at least one receiving bar comprises a plurality of receiving bars that extend therebetween, and wherein the pair of support bars are rotatably coupled to the inner wall surface of the receiving space such that the rack is foldable against the inner wall surface of the receiving space.

13. The apparatus of claim 12, wherein the controller controls at least one of supply time, temperature, or flow rate of heated air supplied by the heated air supplier based on the measured impedance values and the dryness levels.

14. The apparatus of claim 13, further comprising a steam generator provided in the component space, wherein the steam generator generates and supplies steam to the receiving space, and wherein the controller is configured to control the steam generator based on the measured impedance values and the dryness levels.

15. The apparatus of claim 11, wherein the at least one flapper is positioned near a discharge of the heated air supplier into the receiving space, and wherein the controller controls a rotation angle of the at least one flapper based on the measured impedance value and the dryness level.

16. The apparatus of claim 4, wherein the at least one hanger comprises a plurality of hangers each having a ring and a pair of arm parts with a pair of hanger electrode parts respectively provided therewith, and the at least one groove formed in the horizontal bar comprises a plurality of grooves that respectively receives the plurality of hangers therein, wherein the first conductor is exposed at the ring of each of the plurality of hangers such the that the first and second conductors make contact and the pair of hanger electrode parts of each hanger positioned in a respective groove is connected to the controller.

17. The apparatus of claim 1, wherein the at least one electrode part of each of the plurality of holding devices is configured to contact an article held on its respective holding device and to measure an impedance value of the article, and the controller is configured to determine a level of dryness of each of the articles held on the plurality of holding devices based on the measured impedance values, and to control at least one of a supply time, temperature, or flow rate of heated air supplied by the heated air supplier based on the measured impedance value and the dryness level.

18. A fabric treating apparatus, comprising:

a receiving space that receives articles therein to be treated;

a steam generator that supplies steam to the receiving space;

a heated air supplier that supplies heated air to the receiving space;

a plurality of holding devices provided in the receiving space to hold the articles to be treated;

at least one electrode part provided on each of the plurality of holding device so as to be exposed to an article to be held on the holding device;

at least one flapper rotatably coupled to an inner wall surface of the receiving space; and a controller that controls the steam generator, the heated air supplier and the at least one flapper, wherein the controller is electrically connected to the at least one electrode part of each of the plurality of holding devices, and wherein the controller determines a level of dryness of articles held on the holding device based on input from the at least one electrode part of each of the plurality of holding devices and controls operation of the steam generator and the heated air supplier and adjusts a position of the at least one flapper so as to direct heated air toward one or more articles determined to have a lowest dryness level of the articles received in the receiving space.

19. The apparatus of claim 18, wherein the plurality of holding devices comprises:

a horizontal bar that extends across an upper portion of the receiving space; and a plurality of hangers that are detachably coupled to the horizontal bar, wherein the at least one electrode part comprises hanger electrodes provided on an exposed portion of each of the plurality of hangers, wherein the hanger electrodes are electrically connected to the controller via the hanger and the horizontal bar, and wherein the hanger electrodes measure respective impedance levels of articles held on the plurality of hangers, and the controller determines a corresponding level of dryness of the articles based on the impedance levels.

20. The apparatus of claim 19, wherein the plurality of holding devices further comprises a rack provided in the receiving space, spaced apart from the horizontal bar, wherein the rack comprises:

a pair of support bars coupled to an inner wall surface of the receiving space; and a plurality of receiving bars that extend between the pair of support bars so as to receive articles thereon to be treated, wherein the at least one electrode part further comprises rack electrodes provided on an exposed portion of each of the plurality of receiving bars, wherein the rack electrodes are electrically connected to the controller via the pair of support bars, and wherein the rack electrodes measure respective impedance levels of articles held on the plurality of receiving bars, and the controller determines a corresponding level of dryness of the articles based on the impedance levels.

21. The apparatus of claim 20, wherein the controller controls at least one of supply time, temperature, or flow rate of heated air supplied by the heated air supplier, and supply time of steam supplied by the steam generator, based on the measured impedance values and the dryness levels.

22. The apparatus of claim 19, wherein the plurality of flappers are positioned near a discharge of the heated air supplier into the receiving space, wherein the controller controls a rotation angle of the plurality of flappers based on the measured impedance values and the dryness levels so as to guide a flow direction of heated air supplied by the heated air supplier.

* * * * *